US006547632B2

(12) United States Patent
Marine et al.

(10) Patent No.: US 6,547,632 B2
(45) Date of Patent: Apr. 15, 2003

(54) SHUTTLECOCK LOCKOUT MECHANISM

(75) Inventors: Jon C. Marine, Fullerton, CA (US); Simon Chow, Tsuen Wan (HK)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/927,910

(22) Filed: Aug. 10, 2001

(65) Prior Publication Data

US 2002/0049022 A1 Apr. 25, 2002

Related U.S. Application Data

(63) Continuation-in-part of application No. 09/908,971, filed on Jul. 18, 2001.

(60) Provisional application No. 60/224,697, filed on Aug. 11, 2000.

(51) Int. Cl.[7] ..... A63H 13/00

(52) U.S. Cl. ..... 446/354; 446/300; 446/330; 446/353; 446/384; 446/391

(58) Field of Search ..... 446/391, 353, 446/354, 376, 384, 300, 330, 365, 338, 352, 335, 303, 298, 299, 302

(56) References Cited

U.S. PATENT DOCUMENTS

| | | | |
|---|---|---|---|
| 3,298,130 | A | 1/1967 | Ryan |
| 3,583,093 | A | 6/1971 | Glass et al. |
| 3,650,065 | A | 3/1972 | Johmann |
| 3,672,096 | A | 6/1972 | Johmann |
| 3,846,934 | A | 11/1974 | Thorn et al. |
| 3,912,694 | A | 10/1975 | Chiappe et al. |
| 4,023,254 | A | 5/1977 | Aiple et al. |
| 4,073,088 | A | 2/1978 | Beny et al. |
| 4,177,602 | A | 12/1979 | Choi |
| 4,349,987 | A | 9/1982 | Bart |
| 4,516,951 | A | 5/1985 | Saigo et al. |
| 4,563,163 | A | 1/1986 | Herbstler et al. |
| 4,665,640 | A | 5/1987 | Forsse et al. |
| 4,681,993 | A | 7/1987 | Kondo et al. |

(List continued on next page.)

FOREIGN PATENT DOCUMENTS

| | | | |
|---|---|---|---|
| JP | 60241110 | A | 11/1985 |
| JP | 2065887 | A | 3/1990 |
| JP | 3258282 | A | 11/1991 |
| JP | 5253866 | A | 10/1993 |
| WO | WO 01/49383 | A1 | 7/2001 |

OTHER PUBLICATIONS

Selected pages from a book entitled "Machine Devices and Instrumentation", *Kinematics of Intermittent Mechanisms 1—The External Geneva Wheel and Kinematics of Intermittent Mechanisms II—The Internal Geneva Wheel,* Copyright 1966.

Herbert Herkiner, ed., *Engineers' Illustrated Thesaurus,* W. M. Pem Publishing, 1952, pp. 172–173.

Selected pages, Geneva 1 and 2, from book entitled "Mechanism Linkages and Mechanical Controls" author Nicholas Chironis, (c) 1965.

Selected pages, Geneva 3, 4, 5, 6, 7 and 8, from book entitled "Mechanisms and Mechanical Devices 2$^{nd}$ Edition", authors Nicholas Chironis, Neil Sclater, (c) 1996, 1991.

*Primary Examiner*—Derris H. Banks
*Assistant Examiner*—Ali F Abdelwahed
(74) *Attorney, Agent, or Firm*—Kolisch Hartwell, P.C.

(57) ABSTRACT

An interactive, animated, and robotic doll having movable appendages, such as a head, arms, and legs. The doll includes motors, gears and other linkages to actuate the movement of these appendages. A lockout mechanism is operatively incorporated into the doll for preventing conflicting forces from occurring. The lockout mechanism may include a shuttlecock interposed two independent linkages that drive motion in a single appendage. The shuttlecock slides between two positions, each of which limits the movement of a corresponding one of the two linkages when the other of the two linkages is actuating motion in the appendage.

37 Claims, 3 Drawing Sheets

U.S. PATENT DOCUMENTS 4,878,870 A 11/1989 Pastor
5,030,161 A 7/1991 Pastor
5,092,102 A 3/1992 James et al.
5,125,865 A 6/1992 Orenstein et al.
5,158,492 A 10/1992 Rudell et al.
5,224,896 A 7/1993 Terzian
5,236,385 A 8/1993 May
5,310,377 A 5/1994 Joja
5,316,516 A 5/1994 Saitoh
5,394,766 A 3/1995 Johnson et al.
5,405,142 A 4/1995 Arad et al.
5,505,652 A 4/1996 Click
5,647,787 A 7/1997 Raviv et al.
5,747,760 A 5/1998 Skarivoda
5,820,441 A 10/1998 Pracas
5,941,756 A 8/1999 Chou
4,752,272 A 6/1988 Karasawa
4,764,141 A 8/1988 D'Andrade
4,775,352 A 10/1988 Curran et al.
4,819,229 A 4/1989 Pritty et al.

SHUTTLECOCK LOCKOUT MECHANISM

CROSS-REFERENCE TO RELATED APPLICATIONS

This application is based upon and claims priority under 35 U.S.C. §119(e) to the following U.S. provisional patent application, which is incorporated herein by reference in its entirety for all purposes: Ser. No. 60/224,697, entitled "Motorized Doll," filed Aug. 11, 2000. This application is a continuation-in-part and claims priority under 35 U.S.C §120 to U.S. patent application Ser. No. 09/908,971 entitled "Animated Toy with Geneva Mechanism" filed Jul. 18, 2001, the disclosures of which are incorporated herein by reference.

FIELD OF THE INVENTION

The present invention generally relates to a lockout mechanism for interactive animated toys, and more particularly to a mechanism using a shuttlecock to mechanically limit the rotation of a gear or other moving linkage, such that conflicting forces are prevented.

BACKGROUND OF THE INVENTION

Interactive toys are popular for children. Interactive toys having animated features and moving appendages increase the life-like character of the toys. Examples of various interactive, animated or robotic dolls and other toys are found in U.S. Pat. Nos. 4,775,352, 4,808,142, 4,836,465, 4,900,289, 4,923,428, 5,108,341, 5,399,115, 5,820,441, and 5,855,502, the disclosures of which are incorporated herein by reference.

SUMMARY OF THE INVENTION

The present invention includes an interactive, animated, and robotic doll having movable appendages, such as a head, arms, and legs. The doll includes motors, gears and other linkages to actuate the movement of these appendages. A lockout mechanism is operatively incorporated into the doll for preventing conflicting forces from occurring. A conflicting force occurs when two independent linkages configured to actuate the same appendage attempt to move that appendage in opposed directions simultaneously.

The lockout mechanism may include a shuttlecock interposed two independent linkages that drive motion in a single appendage. The shuttlecock slides between two positions, each of which limits the movement of a corresponding one of the two linkages when the other of the two linkages is actuating motion in the appendage. For example, one disclosed embodiment includes a pair of rotating gears configured to drive the movement of a single body part of the doll in opposed directions. Each gear includes a lockout ridge configured to contact the shuttlecock as it rotates causing the shuttlecock to move into a position blocking the rotation of one of the two gears, thus preventing the doll from attempting to drive the body part in opposed directions.

DETAILED DESCRIPTION OF THE INVENTION

Figure 1:
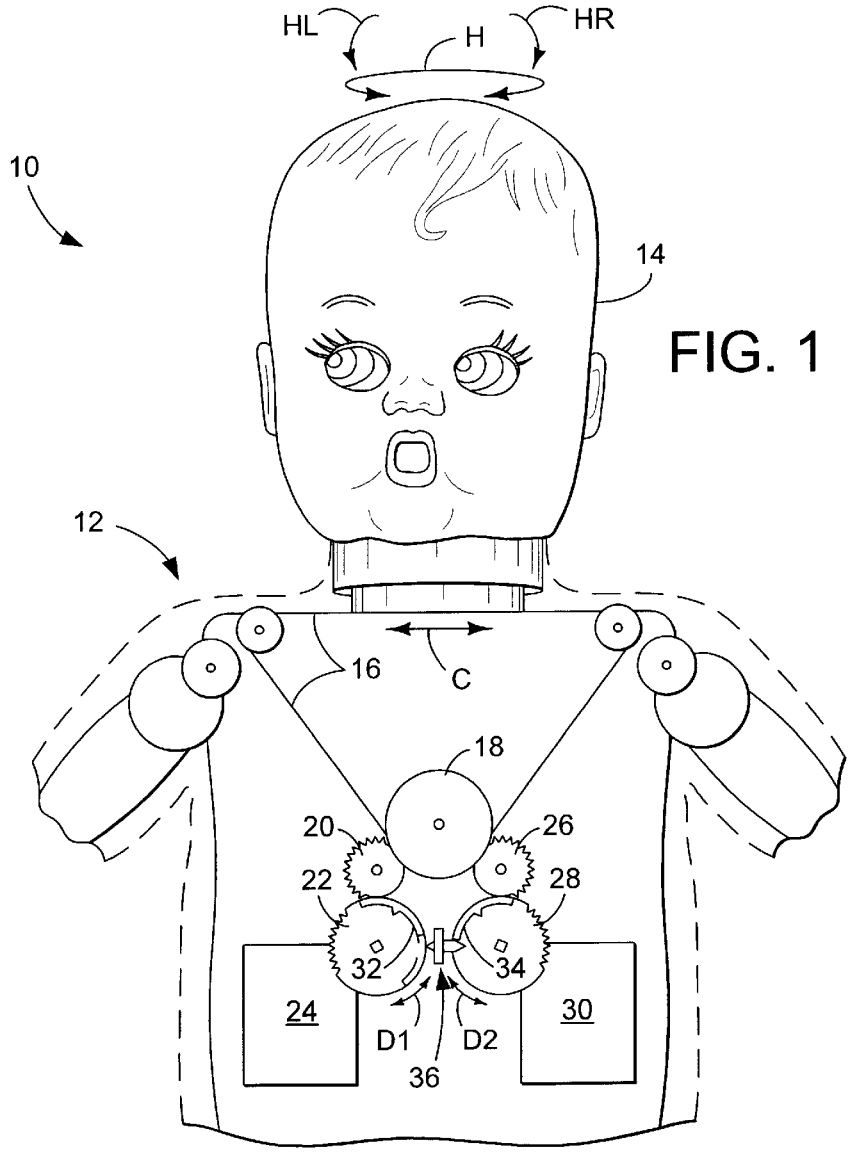
FIG. 1 is a schematic front view of a doll according to the present invention showing first and second drive motors operatively connected to a moveable head, and a lockout subsystem.

Turning initially to FIG. 1, a doll or toy according to one embodiment of the present invention is indicated generally at 10. Doll 10 includes a body 12, which has at least one movable appendage. In the depicted embodiment, a head 14 is the movable appendage.

Head 14 mounts to body 12 and is configured to rotate left and right as indicated by arrow H. A cable 16 connects to head 14 and is operatively linked to a drive pulley 18 in a looped manner. Drive pulley 18 rotates to cause cable 16 to move as indicated by directional arrow C.

A first idler gear 20 is rotated by a first drive gear 22 to drive pulley 18 and cause cable 16 to rotate head 14 from a starting position, as shown in FIG. 1. For example, head 14 may be rotated to the right as indicated by arrow HR. Similarly, head 14 may be rotated back to the starting position by cable 16, drive pulley 18, idler gear 20 and first drive gear 22.

Drive gear 22 is driven by a motor 24. Motor 24 rotates drive gear 22 in both a clockwise and counterclockwise direction, as indicated by arrow D1. Drive gear 22 includes a toothed region along a portion of the gear's perimeter configured to engage idler gear 20, which may have teeth along all, or a portion, of its perimeter. While the toothed region of drive gear 22 is engaged with the teeth of idler gear 20, clockwise rotation of drive gear 22 moves head 14 from a forward facing position toward a right facing position, and counterclockwise rotation by motor 24 of drive gear 22 moves head 14 from a right facing position toward a forward facing position.

Similarly, a second idler gear 26 is rotated by a drive gear 28 to drive pulley 18 and cause cable 16 to rotate head 14 to the left as indicated by arrow HL. Drive gear 28 is driven by a motor 30. Motor 30 rotates drive gear 28 in both a clockwise and counterclockwise direction, as indicated by arrow D2. Clockwise rotation by motor 30 of drive gear 28 moves head 14 from a forward facing position toward a left facing position, and counterclockwise rotation by motor 30 of drive gear 28 moves head 14 from a left facing position toward a forward facing position.

A conflicting condition could occur if both drive gears attempt to drive movement in opposed directions. This conflicting condition may occur when motor 24 is driving first drive gear 22 to rotate head 14 toward the right and motor 30 is driving second drive gear 28 to rotate head 14 toward the left. A lockout subsystem is incorporated into doll 10 to address the potential conflicting condition. The components of the lockout subsystem include a first contact region or first lockout ridge 32 positioned on first drive gear 22, a second contact region or second lockout ridge 34 positioned on second drive gear 28, and a lockout mechanism 36 interposed drive gears 22 and 28. First lockout ridge 32 travels along a first path as drive gear 22 rotates. Similarly, second lockout ridge 34 travels along a second path as drive gear 28 rotates.

Lockout mechanism 36 limits the rotation of drive gear 22 so that it cannot engage idler gear 20, while drive gear 28 is engaging idler gear 26. Similarly, lockout mechanism 36 limits the rotation of drive gear 28 so that it cannot engage idler gear 26, while drive gear 22 is engaging idler gear 20. Thus, lockout mechanism 36 prevents conflicting movements from occurring. By preventing the conflicting movements from occurring lockout mechanism 36 also prevents conflicting forces.

Figure 2:
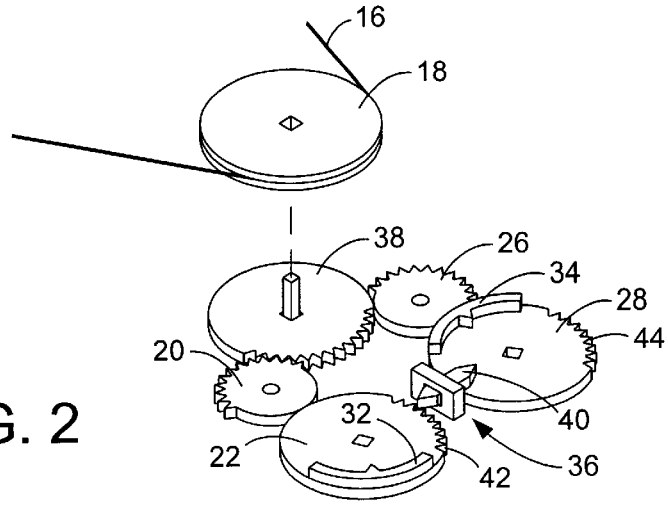
FIG. 2 is an isometric view of the lockout subsystem of FIG. 1.

Turning to FIG. 2, pulley 18 is driven by the interaction of a pulley gear 38 with idler gears 20 and 26. As indicated above, drive gear 22 drives rotation of idler gear 20, which then drives pulley gear 38 and thus pulley 18, cable 16 and head 14. Similarly, drive gear 28 drives rotation of idler gear 26, pulley gear 38, pulley 18, cable 16, and head 14. Lockout mechanism 36 selectively limits rotation of drive gears 22 and 28 by blocking the path of either the first lockout ridge 32 or the second lockout ridge 34. Lockout mechanism 36 includes a shuttlecock 40 that moves back and forth to limit the rotation of drive gears 22 and 28.

Figure 3:
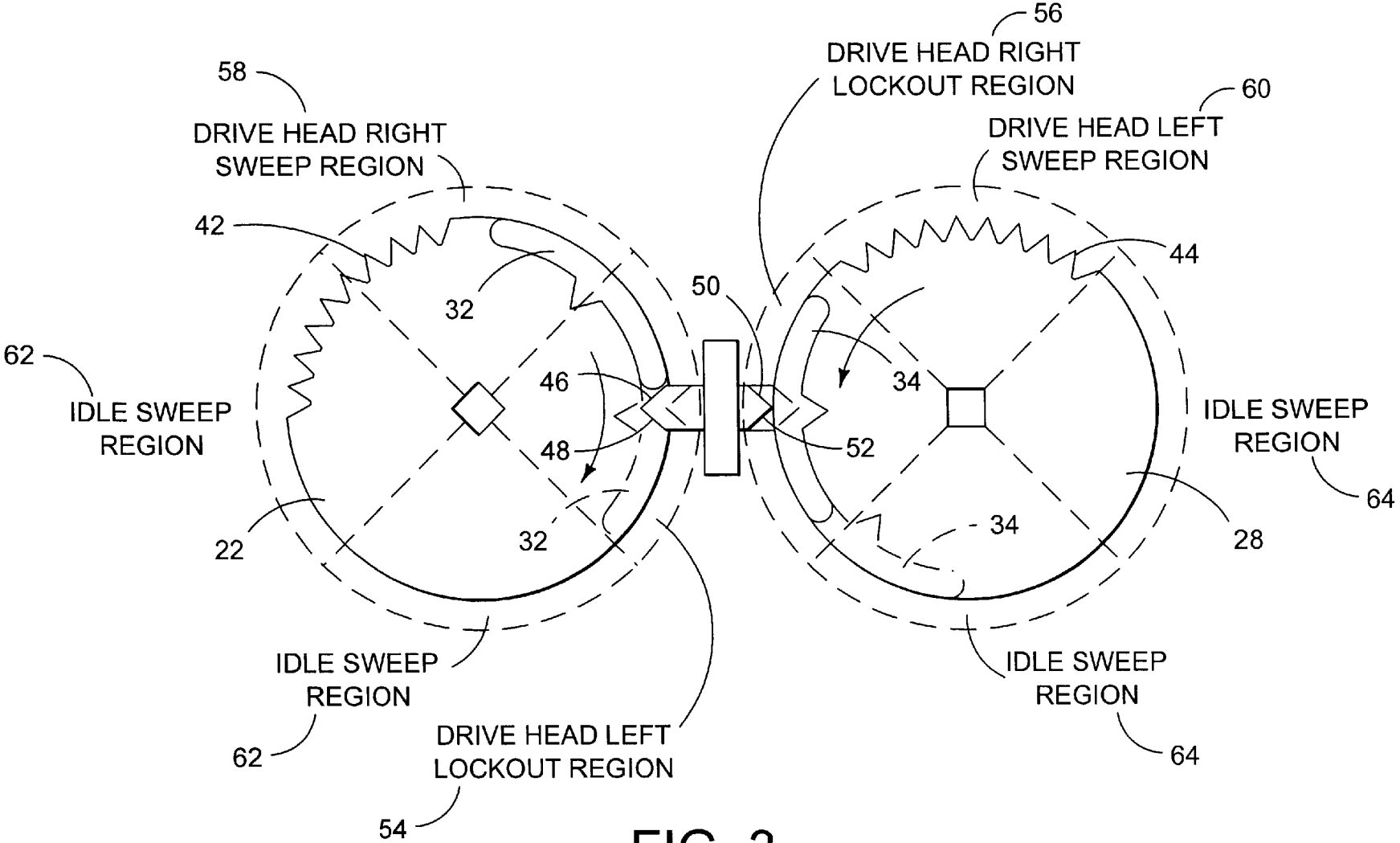
FIG. 3 is a schematic view of the lockout subsystem of FIGS. 1 and 2, showing functional angular sweep regions in dashed lines.

Turning to FIG. 3, the interaction of shuttlecock 40 and lockout ridges 32 and 34 will be better understood. Shuttlecock 40 includes a first-end-clockwise contacting surface 46, a first-end-counterclockwise contacting surface 48, a second-end-counterclockwise contacting surface 50, and a second-end-clockwise contacting surface 52. Each contacting surface moves shuttlecock 40 in response to contact with one of the lockout ridges 32 or 34.

Contacting surface 46 is configured to abut the end of lockout ridge 32 as the ridge is rotating clockwise. Contacting surface 48 is configured to abut the end of lockout ridge 32 as the ridge is rotating counterclockwise. Contacting surface 50 is configured to abut the end of lockout ridge 34 as the ridge is rotating counterclockwise. Finally, contacting surface 52 is configured to abut the end of lockout ridge 34 as the ridge is rotating clockwise.

Drive gears 22 and 28 rotate through distinct functional angular sweep regions. Each sweep region represents a different functional portion of the rotation of a respective one of drive gears 22 and 28. Drive gear 22 travels through a drive-head-left lockout sweep region 54, a drive-head-right sweep region 58, and two idle sweep regions 62. Similarly, drive gear 28 travels through a drive-head-right lockout sweep region 56, a drive-head-left sweep region 60, and two idle sweep regions 64.

Shuttlecock 40 is interposed drive gears 22 and 28, and is positioned to extend into both lockout sweep regions 54 and 56. Shuttlecock 40 engages lockout ridge 32 as it rotates through lockout sweep region 54. Similarly, shuttlecock 40 engages lockout ridge 34 as it rotates through lockout sweep region 56.

Toothed region 42 of drive gear 22 enters drive-head-right sweep region 58 from idle sweep region 62, as drive gear 22 rotates clockwise. Head 14 moves from a forward facing position toward a right facing position as toothed region 42 passes through drive-head-right sweep region 58.

Lockout ridge 32 of drive gear 22 enters drive-head-left-lockout region 54 at the same time toothed region 42 enters drive-head-right sweep region 58. Lockout ridge 32 engages contacting surface 46 as it enters drive-head-left-lockout region 54. Engagement between contacting surface 46 and lockout ridge 32 causes shuttlecock 40 to move towards drive gear 28, out of the travel path of lockout ridge 32 and into the travel path of lockout ridge 34, as shown in dashed lines.

Similarly, counterclockwise rotation of drive gear 22 causes contact between contacting surface 48 and lockout ridge 32, thereby also causing shuttlecock 40 to move toward drive gear 28 out of the travel path of lockout ridge 32 and into the travel path of lockout ridge 34.

In the same way, lockout ridge 34 of drive gear 28 interacts with contacting surfaces 50 and 52 of shuttlecock 40 to move the shuttlecock toward drive gear 22 and out of the travel path of lockout ridge 34.

When toothed region 44 of drive gear 28 is moving through a drive-head-left sweep region 60, lockout ridge 34 is moving through a drive-head-right-lockout region 56, thereby preventing shuttlecock 40 from moving toward drive gear 28. Lockout ridge 34 blocks shuttlecock 40 from moving out of the path of lockout ridge 32 as toothed region 44 of drive gear 28 is rotating through drive-head-left sweep region 60. Shuttlecock 40 prevents toothed region 42 of drive gear 22 from rotating through drive-head-right sweep region 58, thus preventing the conflicting motion condition form occurring.

Figure 4:
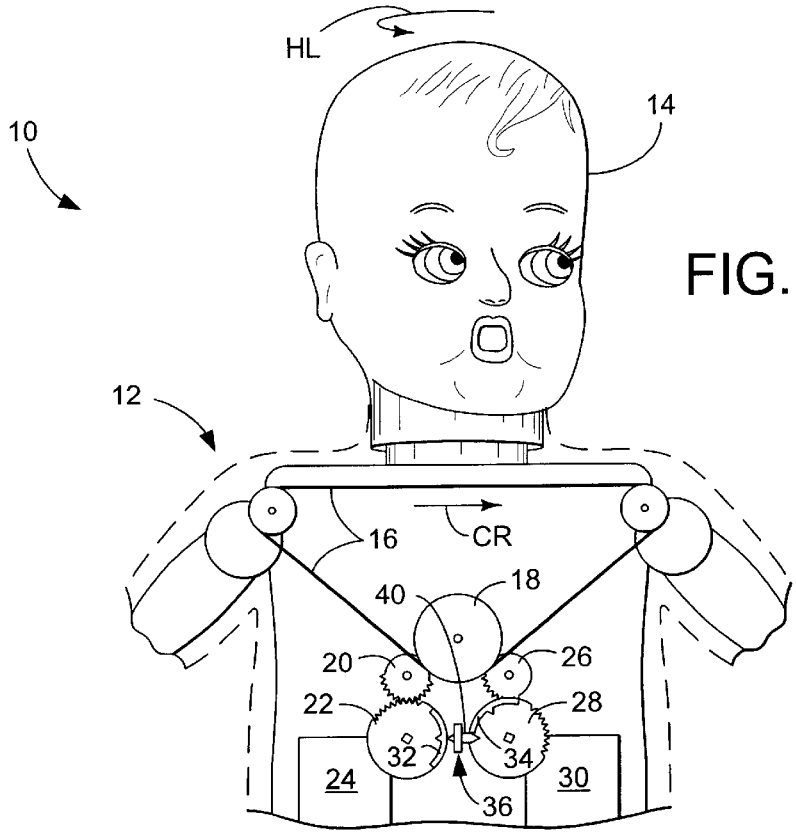
FIG. 4 is a schematic front view of the doll of FIG. 1, with the head rotated left and the lockout subsystem limiting the range of rotation of one drive gear, preventing movement of the head to the doll's right.
Figure 5:
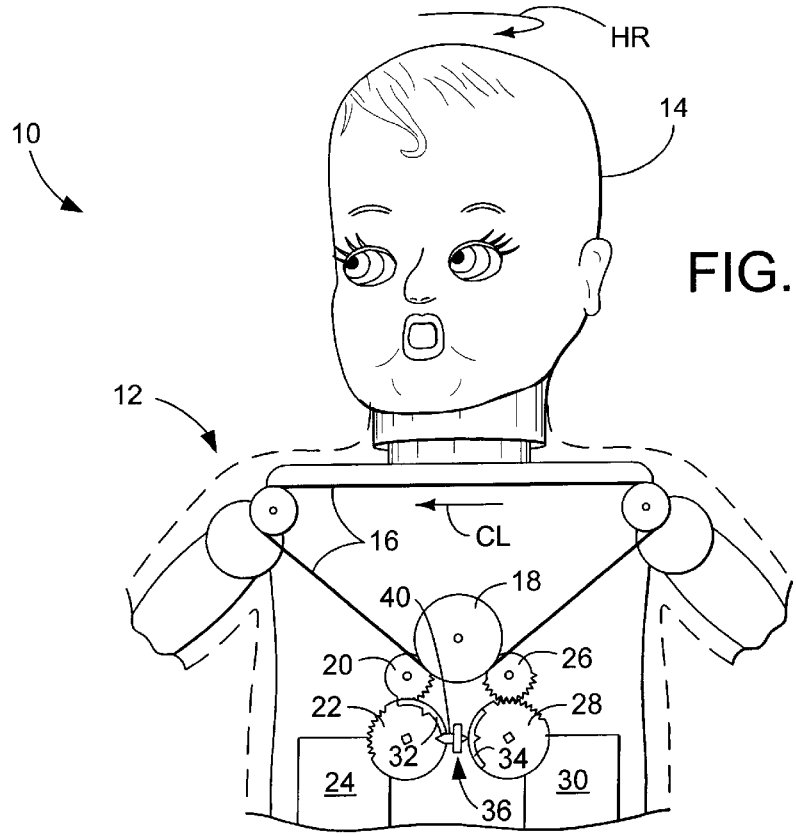
FIG. 5 is a schematic front view of the doll of FIG. 1, with the head rotated right and the lockout subsystem limiting the range of rotation of one drive gear, preventing movement of the head to the doll's left.

The operation of the lockout subsystem is shown in FIGS. 4 and 5. FIG. 4, shows head 14 being driven by drive gear 22 to the doll's left from a center facing position, as indicated by arrow HL. Lockout ridge 32 blocks the movement of lockout mechanism 36, which in turn prevents drive gear 28 from attempting to drive head 14 toward the doll's right.

Similarly, FIG. 5, shows head 14 being driven by drive gear 28 to the doll's right from a center facing position, as indicated by arrow HR. Lockout ridge 34 blocks the movement of lockout mechanism 36, which in turn prevents drive gear 22 from attempting to drive head 14 toward the doll's left.

It should be noted, that FIGS. 1–5 are simplified schematic views and that typically doll 10 would have multiple movable appendages and motors 24 and 30 would drive stacks of drive gears like gears 22 and 28. Each gear in a stack could have a toothed region extending along a portion of the gear. The gears in the stack may have the toothed regions offset angularly, typically offset at 90 degrees, so that as the motor rotates the stack, different gears in the stack are either engaged and actuating different appendages or are, not engaged and not actuating any motion. In this manner each motor may actuate a series of movements within doll 10.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and sub-combinations of the various elements, features, functions and/or properties disclosed herein. Where claims recite "a" or "a first" element or equivalent thereof, such claims should be understood to include incorporation of one or more such elements, neither requiring, nor excluding two or more such elements.

It is believed that the following claims particularly point out certain combinations and sub-combinations that are directed to one of the disclosed inventions and are novel and non-obvious. Inventions embodied in other combinations and sub-combinations of features, functions, elements and/or properties may be claimed through amendment of those claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A toy comprising:

a body having a movable body appendage;

a first and second motor each including a rotatable motor output operatively connected to the movable body appendage; and a lockout subsystem configured to move between two positions, a first position blocking operative connection of the first motor to the movable body appendage, and a second position blocking operative connection of the second motor to the movable body appendage.

2. The toy of claim 1, wherein the lockout subsystem comprises:

a first linkage connecting the rotatable motor output of the first motor to the body appendage and configured to drive a first movement of the body appendage;

a second linkage connecting the rotatable motor output of the second motor to the body appendage and configured to drive a second movement of the body appendage which is opposed to the first movement; and a lockout mechanism configured to selectively limit one of the first movement of the body appendage and the second movement of the body appendage.

3. The toy of claim 2, wherein the first linkage includes a first contact region configured to engage the lockout mechanism and the second linkage includes a second contact region configured to engage the lockout mechanism.

4. The toy of claim 3, wherein the lockout mechanism is interposed the first and second linkage contact regions.

5. The toy of claim 4, wherein the lockout mechanism includes a shuttlecock having:

at least one surface on a first end positioned to engage the first contact region; and at least one surface on a second end positioned to engage the second contact region.

6. The toy of claim 5, wherein the shuttlecock moves between two positions, a first position blocking the movement of the first linkage and a second position blocking the movement of the second linkage.

7. The toy of claim 6, wherein the at least one surface on the first end is angled to enable the first contact region to slide the shuttlecock from the first position to the second position when the first contact region engages the shuttlecock and the at least one surface on the second end is angled to enable the second contact region to slide the shuttlecock from the second position to the first position when the second contact region engages the shuttlecock.

8. The toy of claim 7, wherein the shuttlecock moves to the first position upon engagement of the second contact region with the at least one surface on the second end of the shuttlecock.

9. The toy of claim 7, wherein the shuttlecock moves to the second position upon engagement of the first contact region with the at least one surface on the first end of the shuttlecock.

10. The toy of claim 1, wherein the lockout subsystem comprises:

a first drive gear configured to drive a first movement in the movable body appendage and to include a first contact region that travels along a first path;

a second drive gear configured to drive a second movement in the movable body appendage and to include a second contact region that travels along a second path; and a lockout mechanism interposed the first and second drive gears, and configured: to be engaged by the first contact region and to respond by moving to extend over a portion of the second drive gear obstructing the travel of the second contact region along the second path while the first contact region engages the lockout mechanism, thereby limiting the rotation of the second drive gear; and to be engaged by the second contact region and to respond by moving to extend over a portion of the first drive gear obstructing the travel of the first contact region along the first path while the second contact region engages the lockout mechanism, thereby limiting the rotation of the first drive gear.

11. The toy of claim 10, wherein the lockout mechanism includes a shuttlecock having:

at least one surface on a first end positioned to engage the first contact region; and at least one surface on a second end positioned to engage the second contact region.

12. The toy of claim 10, wherein the shuttlecock includes:

a first end having a first clockwise surface configured to engage the first contact region as the first drive gear rotates clockwise and a first counterclockwise surface configured to engage the first contact region as the first drive gear rotates counterclockwise; and a second end having a second clockwise surface configured to engage the second contact region as the second drive gear rotates clockwise and a second counterclockwise surface configured to engage the second contact region as the second drive gear rotates counterclockwise.

13. A toy comprising:

a body having a movable appendage;

a gear assembly configured to drive movement in the movable appendage and having a first drive gear with a first contact region configured to travel along a first path and a second drive gear with a second contact region configured to travel along a second path;

a motor assembly including a first motor having a first motor output and a second motor having a second motor output, wherein the first drive gear is mounted on the first motor output and the second drive gear is mounted on the second motor output and wherein the first and second motor outputs are positioned to selectively drive opposed movement in the appendage; and a lockout mechanism interposed the first and second drive gears for engagement with the contact region of each of the drive gears, wherein the lockout mechanism is configured to be moved by the first contact region when the second contact region is not engaged by the lockout mechanism, and to block movement of the first contact region when the second contact region is engaged by the lockout mechanism.

14. The toy of claim 13, wherein the movable appendage is a head.

15. The toy of claim 14, wherein the first drive gear and the second drive gear each have a perimeter that is circular.

16. The toy of claim 15, wherein the first drive gear and the second drive gear each include a toothed region positioned along a portion of the perimeter of each of the first and second drive gears.

17. The toy of claim 15, wherein the first and second contact regions of the first and second drive gears extend axially from each drive gear and are positioned along a portion of the perimeter of that drive gear.

18. The toy of claim 15, wherein the lockout mechanism includes a shuttlecock having surfaces configured to interact with the contact regions of each of the drive gears.

19. The toy of claim 18, wherein the shuttlecock surfaces include a pair of clockwise surfaces that interact with the contact regions when the drive gears are rotating clockwise and wherein the shuttlecock surfaces include a pair of counterclockwise surfaces that interact with the contact regions when the drive gears are rotating counterclockwise.

20. A toy comprising:

a body having a movable appendage;

a gear assembly configured to drive the motion of the movable appendage, wherein the gear assembly includes at least two independent drive gears configured to selectively drive the movable appendage in opposed directions; and a lockout mechanism configured to limit drive motion of the independent drive gears preventing the drive gears from driving the movable appendage in opposed directions at the same time, wherein:

the lockout mechanism includes a shuttlecock that is moveable to a first position in which the shuttlecock prevents a first of the two independent drive gears from moving through a first predefined angular sweep; and the shuttlecock is moveable to a second position in which the shuttlecock prevents a second of the two drive gears from moving through a second predefined angular sweep.

21. The toy of claim 20, wherein each of the two independent drive gears include a toothed region extending along a portion of each drive gear, and wherein the toothed region of each drive gear is configured to drive the moveable appendage as each drive gear rotates through a predefined angular sweep.

22. The toy of claim 21, wherein each of the two independent drive gears includes a lockout ridge positioned to engage the shuttlecock when the toothed region of each drive gear begins to rotate through the predefined angular sweep of that drive gear.

23. The toy of claim 22, wherein the shuttlecock has two positions, a first position in which the lockout ridge of a first of the two independent drive gears engages the shuttlecock as that gear rotates through the predefined angular sweep of that drive gear, and a second position in which the lockout ridge of a second of the two independent drive gears engages the shuttlecock as the second of the two independent drive gears rotates through the predefined angular sweep of that second drive gear.

24. The toy of claim 21, wherein the movable appendage driven by the independent drive gears includes a head.

25. The toy of claim 14, wherein the first drive gear and the second drive gear each have a perimeter that includes an arcuate portion.

26. A toy comprising:

a body having a movable body appendage;

a first and second motor each including a rotatable motor output operatively connected to the movable body appendage; and a lockout subsystem configured to prevent the movable body appendage from being driven in opposed directions, wherein the lockout subsystem comprises:

a first drive gear configured to drive a first movement in the movable body appendage and to include a first contact region that travels along a first path;

a second drive gear configured to drive a second movement in the movable body appendage and to include a second contact region that travels along a second path; and a lockout mechanism interposed the first and second drive gears, and configured:

to be engaged by the first contact region and to respond by moving to extend over a portion of the second drive gear obstructing the travel of the second contact region along the second path while the first contact region engages the lockout mechanism, thereby limiting the rotation of the second drive gear; and to be engaged by the second contact region and to respond by moving to extend over a portion of the first drive gear obstructing the travel of the first contact region along the first path while the second contact region engages the lockout mechanism, thereby limiting the rotation of the first drive gear.

27. The toy of claim 26, wherein the lockout mechanism includes a shuttlecock having:

at least one surface on a first end positioned to engage the first contact region; and at least one surface on a second end positioned to engage the second contact region.

28. The toy of claim 26, wherein the shuttlecock includes:

a first end having a first clockwise surface configured to engage the first contact region as the first drive gear rotates clockwise and a first counterclockwise surface configured to engage the first contact region as the first drive gear rotates counterclockwise; and a second end having a second clockwise surface configured to engage the second contact region as the second drive gear rotates clockwise and a second counterclockwise surface configured to engage the second contact region as the second drive gear rotates counterclockwise.

29. A toy comprising:

a body having a movable body appendage;

a fist motor including a rotatable motor output operatively connected to the movable body appendage through a first drive gear having a first axis of rotation;

a second motor including a rotatable motor output operatively connected to the movable body appendage through a second drive gear having a second axis of rotation;

a lockout subsystem configured to prevent the movable body appendage from being driven in opposed directions, wherein the lockout subsystem includes a shuttlecock interposed the first and second drive gears and aligned with the first axis of rotation and the second axis of rotation.

30. The toy of claim 29, wherein the lockout subsystem comprises:

a first linkage connecting the rotatable motor output of the first motor to the body appendage and configured to drive a first movement of the body appendage;

a second linkage connecting the rotatable motor output of the second motor to the body appendage and configured to drive a second movement of the body appendage which is opposed to the first movement; and a shuttlecock configured to selectively limit one of the first movement of the body appendage and the second movement of the body appendage.

31. The toy of claim 30, wherein the first linkage includes a first contact region configured to engage the shuttlecock and the second linkage includes a second contact region configured to engage the shuttlecock.

32. The toy of claim 31, wherein the shuttlecock is interposed the first and second linkage contact regions.

33. The toy of claim 32, wherein the shuttlecock includes:

at least one surface on a first end positioned to engage the first contact region; and at least one surface on a second end positioned to engage the second contact region.

34. The toy of claim 33, wherein the shuttlecock moves between two positions, a first position blocking the movement of the first linkage and a second position blocking the movement of the second linkage.

35. The toy of claim 34, wherein the at least one surface on the first end is angled to enable the first contact region to slide the shuttlecock from the first position to the second position when the first contact region engages the shuttlecock and the at least one surface on the second end is angled to enable the second contact region to slide the shuttlecock from the second position to the first position when the second contact region engages the shuttlecock.

36. The toy of claim 35, wherein the shuttlecock moves to the first position upon engagement of the second contact region with the at least one surface on the second end of the shuttlecock.

37. The toy of claim 35, wherein the shuttlecock moves to the second position upon engagement of the first contact region with the at least one surface on the first end of the shuttlecock.

* * * * *